United States Patent [19]

Fantacci et al.

[11] Patent Number: 4,719,871

[45] Date of Patent: Jan. 19, 1988

[54] SHIP WITH MONOCOQUE HULL MADE OF PLASTIC-BASED COMPOSITE MATERIAL

[75] Inventors: Gianfranco Fantacci, Bolano; Gianfranco De Casa, Massa, both of Italy

[73] Assignee: Intermarine S.p.A., Sarzana, Italy

[21] Appl. No.: 839,670

[22] Filed: Mar. 14, 1986

[30] Foreign Application Priority Data

Mar. 15, 1985 [IT] Italy ..... 12454 A/85

[51] Int. Cl.[4] ..... B32B 3/26

[52] U.S. Cl. ..... 114/357; 114/65 R; 114/78; 114/85

[58] Field of Search ..... 114/56, 357, 65 R, 68, 114/78, 85

[56] References Cited

U.S. PATENT DOCUMENTS

| | | | |
|---|---|---|---|
| 3,229,433 | 1/1966 | Miles | 114/85 |
| 3,439,366 | 4/1969 | Matthews | 114/357 |
| 3,911,190 | 10/1975 | Myers et al. | 114/357 |
| 4,193,367 | 3/1980 | Benincosa et al. | 114/68 |

FOREIGN PATENT DOCUMENTS

| | | | |
|---|---|---|---|
| 55-127276 | 10/1980 | Japan | 114/357 |

*Primary Examiner*—Joseph F. Peters, Jr.
*Assistant Examiner*—Edwin L. Swinehart
*Attorney, Agent, or Firm*—Pollock, Vande Sande & Priddy

[57] ABSTRACT

This invention relates to a ship having a monocoque or unitary-construction hull (1) made of a composite material having a base of suitably-reinforced plastics. According to the invention, the longitudinal strength of the hull (1) mainly derives from the monocoque or unitary-construction hull and the decks (4). Optional transverse reinforcing structures may be constituted exclusively by structural transverse bulkheads (5). The thickness of the monocoque hull (1) increases, preferably in a substantially uninterrupted manner, from the stringer area towards the keel (2). The keel (2) and the rolling chocks (3) are integral with, and made of the same material as, the monocoque hull (1). At least some tanks are constituted by cylinders (8, 8', 9) made of a plastics-based composite material and suspended, at a certain height from the bottom of the hull (1), between two successive structural transverse bulkheads (5).

3 Claims, 2 Drawing Figures

SHIP WITH MONOCOQUE HULL MADE OF PLASTIC-BASED COMPOSITE MATERIAL

FIELD OF THE INVENTION

This invention relates to a ship of the type having a monocoque or unitary-construction hull made of a composite material, more particularly a suitable reinforced plastics-based material, such as, for example, sandwiched laminated materials having a base of either plastics material or fiberglass-reinforced plastics material, or the like.

BACKGROUND OF THE INVENTION

The use of plastics-based composite materials when building ships of considerable size and characteristics, such as 30 to 100 meters long, has been limited heretofore by technical and economical factors that have prevented a larger use of said materials. This is due mainly to the fact that, usually, the builders have endeavored to reproduce by said materials structural shapes which were suitable for wood, steel or light alloys. The main disadvantages of these constructional principles followed heretofore were the poor stiffness of hulls at a parity of weight, due to the low modulus of elasticity of said materials, and the high building costs due to the extensive use of labor as a result of the complicated structure designed according to said principles followed until now.

SUMMARY OF THE INVENTION

This invention aims to overcome said disadvantages and resides, substantially, in the fact that the longitudinal strength of the hull mainly derives from the monocoque or unitary-construction hull and the decks, while the optional transverse reinforcing structures may be constituted exclusively by structural transverse bulkheads (watertight or not), and the thickness of the monocoque hull increases from a certain height towards the keel.

Considerable structural stiffness of the hull is thus obtained as a result of the location of the material as spaced practicable from the neutral axis of the ship. At the same time, constructional simplification is obtained as a result of the construction principle of the increasing thickness of the hull, to which only the structural bulkheads and decks are to be added.

Preferably, according to a further characteristic of the invention, the thickness of the monocoque hull increases substantially uninterruptedly, preferably beginning from the stringer area, towards the keel. Moreover, the keel and/or rolling chocks are integral with, and of the same material as, the monocoque hull, and they are formed simultaneously with the hull. According to a still further characteristic of the invention, at least some decks, particularly the internal decks (and the element carried thereon) are supported by the structural transverse bulkheads through longitudinal carrying beams arranged under said decks. Preferably, the decks and structural bulkheads are also made of plastics-based composite materials and, in this instance, the longitudinal carrying beams for the decks are, preferably, integral with, and of the same material as, the respective decks.

According to an important characteristic of the invention, at least some of the tanks of the ship, such as the fuel and/or the fresh water tanks, are constituted by cylinders of plastics-based composite materials and are suspended between successive structural transverse bulkheads, at a certain height from the bottom of the hull. Thus, said tanks become a structural part of the ship and act as additional strengthening beams, in addition to the decks. Moreover, said embodiment and arrangement of the tanks render the bilge thoroughly unobstructed and easily inspected.

According to a further characteristic of the invention, at least some engines and/or machinery are supported by decks and/or structural bulkheads and/or are arranged on suitable cradles or cells made of a plastics-based composite material and suspended between successive structural transverse bulkheads.

BRIEF DESCRIPTION OF THE DRAWINGS

These and other characteristics of the invention and the advantages resulting therefrom will be apparent from the following description of a preferred embodiment thereof shown diagrammatically as a non-limiting example in the accompanying drawings, wherein.

DESCRIPTION OF THE PREFERRED EMBODIMENT

Figure 1:
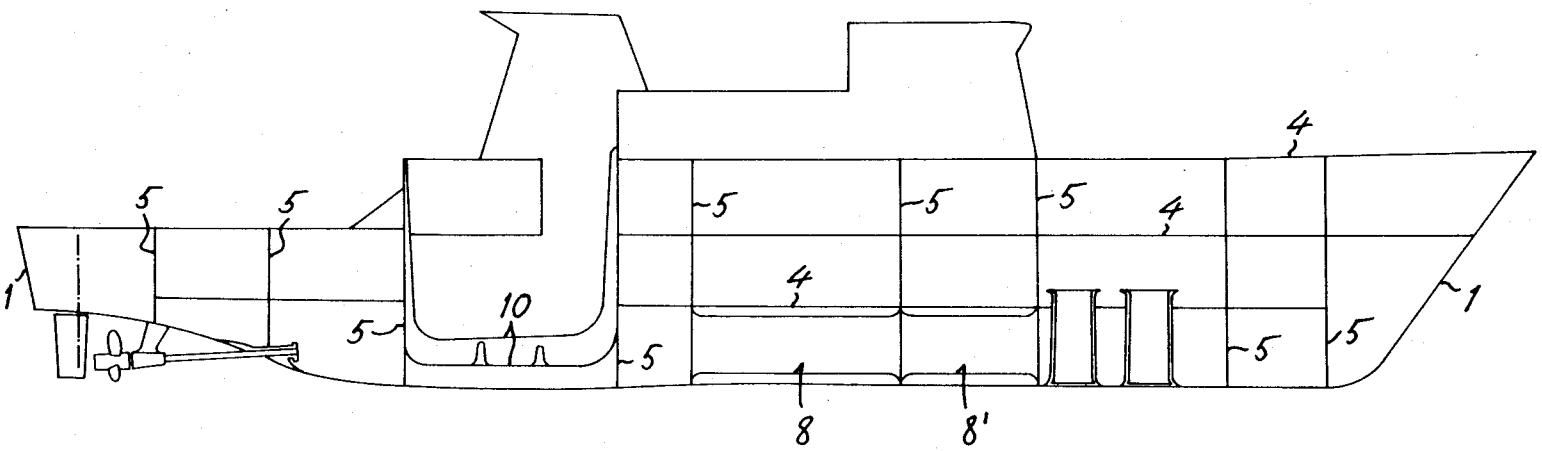
FIG. 1 is a fore-and-aft section of the structure of a ship according to the invention.
Figure 2:
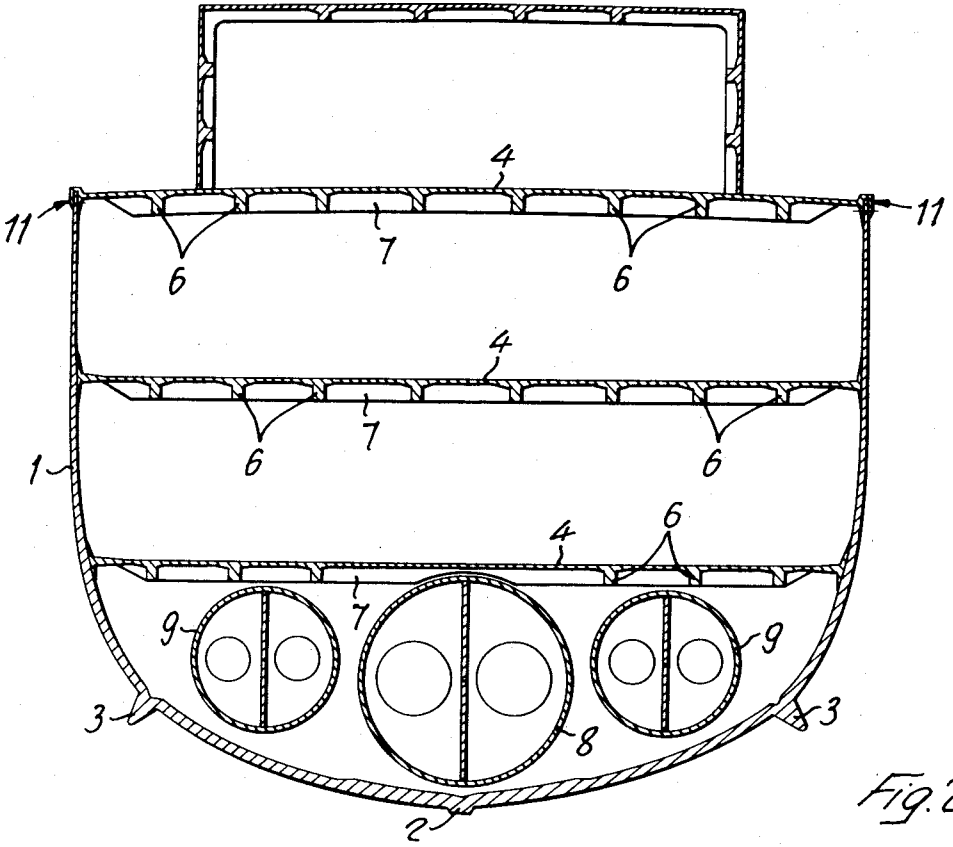
FIG. 2 is a midship cross section thereof.

With reference to the drawings, the numeral 1 indicates the hull of the ship, of the unitary-construction or monocoque type and made of a plastics-based composite material, particularly of fiberglass-reinforced plastics, or the like. The keel 2 and the rolling chocks 3 of the hull are integral with the monocoque hull 1 and are made of the same material as said hull upon the formation of the latter. The thickness of the monocoque hull 1 increases substantially uninterruptedly, for example, from the stringer area 11 to the keel 2.

The longitudinal strength of the ship's hull 1 derives only from the monocoque hull and decks 4, while the transverse reinforcing structures are constituted exclusively by structural transverse bulkheads 5 which may or may not be of the watertight type. The decks 4 (and, therefore, the elements carried thereon) are supported by the structural transverse bulkheads 5 by means of longitudinal reinforcing beams 6 arranged under said decks 4. Of course, the decks 4 may be provided with transverse reinforcing beams 7 as well. Preferably, the transverse structural bulkheads 5 and decks 4 are also made of a composite material having a base of suitable reinforced plastics. In this instance, the longitudinal beams 6 and transverse beams 7 of the decks 4 are integral with the respective deck 4 and are made of the same material as said deck upon the formation of the latter.

The tanks 8, 8' and 9 for fuel and freshwater are constituted by rugged cylinders made of reinforced plasticsbased composite material and suspended, at a certain height from the bottom of the monocoque hull 1, between successive structural transverse bulkheads 5, as viewed particularly in FIG. 1. Therefore, the tanks 8, 8', and 9 are independent from the bottom of the hull 1 and permit free access into the bilge for inspection, while constituting additional strengthening longitudinal beams.

The engines and machinery are arranged either on the decks 4 or the structural bulkheads 5, or they are supported on suitable cradles or cells 10 made of reinforced plastics-based composite material and suspended between successive structural transverse bulkheads 4 at a certain height from the bottom of the monocoque hull 1.

We claim:

1. A ship having decks (4), a stringer area, a monocoque hull (1), and a keel (2) and rolling chocks (3), wherein (a) the thickness of said monocoque hull increases substantially uninterruptedly from said stringer area to said keel;

(b) at least some of said decks are supported by transverse structural bulkheads (5) via longitudinal carrying beams (6) arranged under respective said decks and made integral therewith;

(c) said keel (2) and said rolling chocks (3) are both integral with said monocoque hull (1); and (d) said monocoque hull, said decks, said transverse structural bulkheads, said longitudinal carrying beams, said keel and said rolling chocks are all made of the same composite material with a reinforced plastics base.

2. A ship according to claim 1, wherein said ship has fuel and water tanks, at least one of said tanks being constituted by a cylinder made of a composite material with a reinforced plastics base, and being suspended between successive transverse structural bulkheads and at a predetermined spacing from a bottom of said hull.

3. A ship according to claim 1, wherein said ship has a plurality of engine and/or equipment units, at least some of said units being arranged on cradles or cells made of a composite material with a reinforced plastics base and suspended between successive structural transverse bulkheads.

* * * * *